United States Patent [19]

Hofmann-Igl

[11] Patent Number: 4,617,949

[45] Date of Patent: Oct. 21, 1986

[54] SCALP APPLICATOR

[75] Inventor: Ernest Hofmann-Igl, Kampen auf Sylt, Fed. Rep. of Germany

[73] Assignee: Basotherm GmbH, Biberach an der Riss, Fed. Rep. of Germany

[21] Appl. No.: 659,653

[22] Filed: Oct. 11, 1984

Related U.S. Application Data

[63] Continuation of Ser. No. 344,555, Feb. 1, 1982, abandoned.

[30] Foreign Application Priority Data

Feb. 17, 1981 [DE] Fed. Rep. of Germany ..... 3105802

[51] Int. Cl.[4] ..... A45D 40/30

[52] U.S. Cl. ..... 132/88.5; 425/522

[58] Field of Search ..... 132/88.5, 88.7, 112, 132/113; 425/522

[56] References Cited

U.S. PATENT DOCUMENTS 1,574,418 2/1926 Coviello ..... 132/113 XR 4,211,247 7/1980 Morganroth ..... 132/88.7

*Primary Examiner*—Gregory E. McNeill

*Attorney, Agent, or Firm*—Hammond & Littell, Weissenberger & Dippert

[57] ABSTRACT

This invention relates to an apparatus for applying materials to the scalp. More specifically, this invention relates to a scalp applicator means comprising a hollow body and an applicator means, said applicator means comprising two forked prongs, each of which prongs has at its end at least one outlet or spray opening, the outlets or spray openings on each prong being positioned laterally on the sides of the prongs away from each other.

5 Claims, 7 Drawing Figures

SCALP APPLICATOR

This application is a continuation of co-pending U.S. patent application Ser. No. 344,555, filed Feb. 1, 1982 now abandoned.

FIELD OF THE INVENTION

This invention relates to an apparatus for applying materials to the scalp. More specifically, this invention relates to a scalp applicator or scalp moistener having forked prongs which is useful for applying liquids to the scalp.

BACKGROUND OF THE INVENTION

It has been customary to moisten the scalp with tinctures or other scalp-care agents by means of a bottle having a narrowed opening at the end of a bottleneck, said opening usually being closable by a screw closure. The bottles are either moved across the scalp so that the narrowed opening contacts the surface of the scalp or are used as spray bottles. It is also customary for certain applications to moisten a cotton wad or the like with the tincture or scalp-care agent and to then contact the scalp with this moistened wad after the hair has been bent aside at the desired point. With such applications the dosage tends to be very imprecise and, more particularly, there is virtually no control with the result that hair or scalp which does not require treatment is moistened, even complete moistening being achieved in some cases.

OBJECTS OF THE INVENTION

It is an object of the invention to provide a means for applying materials to the scalp in a controlled manner.

It is also an object of the invention to provide a novel scalp applicator or moistener.

It is a further object of the invention to provide a scalp applicator or moistener which makes it possible to apply tinctures or scalp-care agents to the scalp in a controlled manner, thereby avoiding unnecessary wetting of the hair and decreasing or preventing waste of the tincture or scalp-care agent.

It is a yet further object of the invention to provide a scalp applicator or moistener comprising a hollow body with two forked prongs, each prong having at its end at least one outlet or spray opening, said openings being located laterally on the sides of the prongs away from each other.

These and other objects of the invention will become more apparent in the description below.

DETAILED DESCRIPTION OF THE INVENTION

Figure 1:
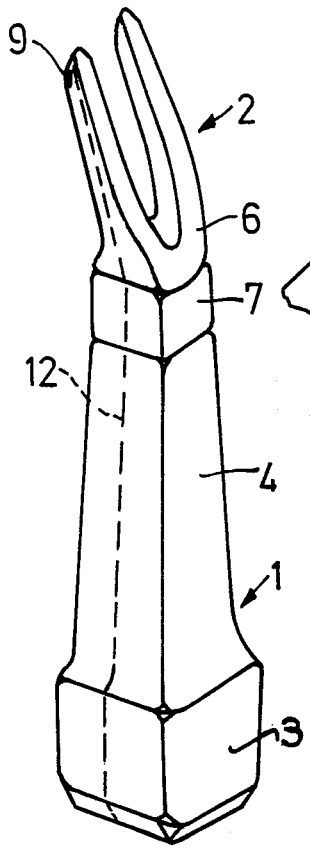
FIG. 1 shows in perspective a scalp applicator according to the invention designed as an upright bottle, viewed obliquely from above.

Applicant has developed a scalp applicator or scalp moisturizer (hereafter referred to merely as "scalp applicator") which facilitates applying liquid substances to the scalp in a controlled manner. The scalp applicator comprises a hollow body with two forked prongs, each prong having at its end at least one outlet or spray opening. The outlets or spray openings are located laterally on the sides of the prongs in such a manner that the one or more outlets or spray openings for one prong point away from the one or more outlets or spray openings for the other prong.

When the scalp applicator according to the invention is used, the prongs are placed on the scalp simultaneously and are pushed or moved along the surface of the scalp. Hairs on the scalp are necessarily parted, and the substance to be applied can be applied directly to the scalp and in reliable dosages by putting pressure on the bottle when the prongs are positioned at the desired location on the scalp. The use of two prongs has the advantage that when both prongs are simultaneously placed on the scalp, the exact positioning of the outlets or spray openings is fixed.

The main body of each prong, which, of course, is also hollow to facilitate passage of the material to be applied to the scalp, can have a cross-section of virtually any shape. However, it is preferred that the cross-section be substantially square with rounded edges. Preferably each prong will decrease in cross-sectional area along its length, i.e., toward its free end, or tip. Also, in a preferred embodiment the outlets or spray openings will be arranged at an edge that would be substantially adjacent to the scalp during application. Moreover, the tips of the prongs are shaped or beveled in such a manner that the tips will act as "skids" to facilitate movement of the prongs along the scalp. This arrangement, on the one hand, prevents direct contact of the openings with the scalp and the resultant possible clogging by skin "flakes" and, on the other hand, facilitates unimpeded spraying or application.

It is also preferred that the body of the scalp applicator be essentially block-shaped with an elongated neck and a thickened base or lower area and that the walls of the body be cambered in the neck region. Such an arrangement should permit the applicator to be set or stored on end, i.e., on the base, so that the outlet or spray openings will be positioned above the liquid level and that no liquid will be lost, other than by evaporation, when the spray openings are not closed. It is further preferred that the prongs be inclined away from the longitudinal axis of the bottle and that the base and tip of the prongs be on opposite sides of the body with respect to the longitudinal axis.

The above arrangement facilitates the holding and guiding of the bottle and assures optimum exertion of pressure during application.

The body and prongs of the scalp applicator according to the invention can be comprised of virtually any rigid yet flexible material, such as one of the well-known polymer or copolymer materials. Preferably the scalp applicator parts are comprised of polyethylene or a copolymer thereof. In an especially preferred embodiment, the scalp applicator is formed of HOSTAL- EN ®, a polyethylene available from Hoechst. The use of such rigid but flexible material results in an especially stable bottle.

The scalp applicator according to the invention can perhaps be better appreciated by making reference to the embodiments of the invention set forth in the drawings. In FIG. 1, the scalp applicator has been represented as an upright bottle comprised of two segments. The first segment is the hollow body 1, which receives the liquid to be applied, and the other segment is closure 2, the actual applicator or moistener means.

Hollow body 1 has a block-shaped, convex base 3, which gradually blends or meets with a similarly block-shaped neck 4 of smaller cross-section. The walls of the neck 4 are slightly cambered, and the neck 4 has at its top a screw thread 5 intended to engage reciprocal screw threading in closure 2.

Figure 2:
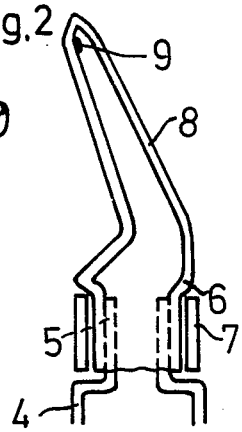
FIG. 2 represents a vertical partial section through a prong with contiguous bottle closure.
Figure 4:
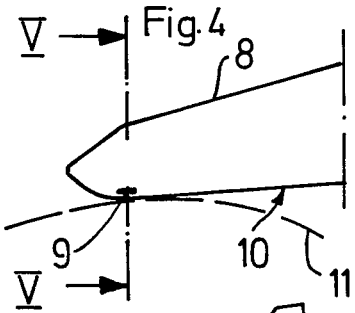
FIG. 4 shows in a partial view the position of the outlet or spray opening of a prong.
Figure 5:
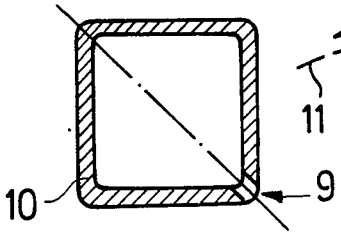
FIG. 5 is a transverse section along line V—V in FIG. 4.

As can be seen more clearly in FIG. 2, closure 2 is formed as a screw cap 6 with coupling sleeve 7 and extends upwardly to forked, hollow prongs 8, the interior of the closure 2 opening into the interior of body 1. The two prongs 8 are parallel to each other and slant from one side of the bottle neck to the other, preferably in such a way that tips of the prongs would be contained by a plane coextensively with the corresponding side of foot 3 of the body 1. In addition, the prongs 8 have a decreasing cross-section that is substantially square with rounded edges. At the tip of each prong 8, the prong comes to a slightly arched or beveled point. Each prong 8 has an outlet or spray opening 9, located on the side away from the other prong and formed on the diagonal on the substantially square cross-section. During application, outlet or spray opening 9 is in edge 10 which lies closest to the scalp during use of the scalp applicator of the invention. (See, FIG. 5.)

Figure 6:
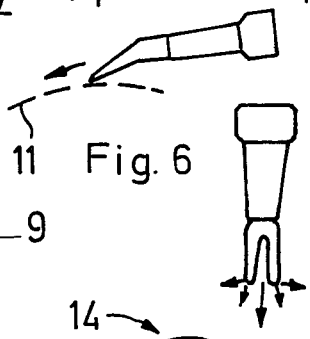
FIG. 6 shows in elevation and plan, on a reduced scale, the use of the scalp applicator shown in FIGS. 1 to 5.

Due to the rounding of the edges, the opening or outlet 9 can lie within the roundness of the edge so that the opening does not come in contact with the scalp. The outlet or spray openings are provided by subsequently piercing the material. Advantageously the spray openings are inclined somewhat forward, as can be seen from FIG. 6.

The chosen inclination of the prongs 8 relative to the longitudinal axis of bottle 1 permits easy use at any point on the head, with the thickened base 3 forming a grip means for the hand, particularly for convenient gripping and squeezing of the neck 4 by the thumb and forefinger. The scalp applicator is then pushed or moved along the scalp in the manner indicated by the arrow in FIG. 6, the prongs 8 having contact with the head and spreading hairs apart as they are moved forward.

The bottle should be made of a flexible material, such as a flexible plastic material, and should most expediently be produced by blow molding. The body 1 and closure 2 are produced as independent blow moldings, the dividing plane of the molding tools being expediently placed so that with regard to the closure 2 it lies outside of the region that comes in contact with the scalp. In FIG. 1 a suitable position is represented by broken line 12.

The coupling sleeve 7 serves to continue the neck contour to closure 2 and to facilitate aligning the prongs 8 with the neck in the manner intended for the handling described above.

Figure 3:
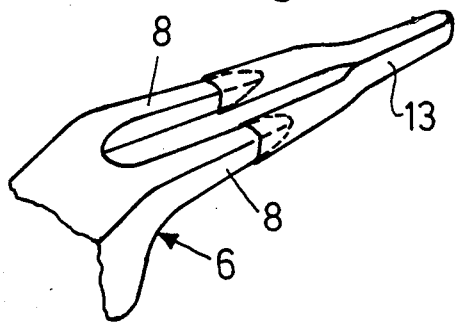
FIG. 3 shows in perspective a plug closure for the prongs of the scalp applicator according to FIGS. 1 and 2.

To close the outlets or spray openings 9 between applications, a suitable capping means should be used. Such capping means can comprise a hose 13 bent in "V" form, which is bonded or cemented at the bend and is, as is set forth in FIG. 3, slipped on by its ends. Because of its circular cross-section, which differs from the substantially square cross-section of the tips of the prongs 8, such a hose particularly applies tension or pressure to the prong tips and thus assures complete closure of the outlet openings. Also, due to the bonding or cementing at the bend of the hose, a certain spreading force must additionally be exerted to apply the hose to the prong tips, and this results in a reactive force which tends to apply additional force to the outlets or spray openings 9. Lastly, there is a certain cross-section reduction due to the bending and bonding or cementing operation so that a wedge or clamping effect occurs, thus assuring an even better fit. It should be noted that instead of a hose having circular cross-section, a suitable V-shaped injection molded piece could be used.

Figure 7:
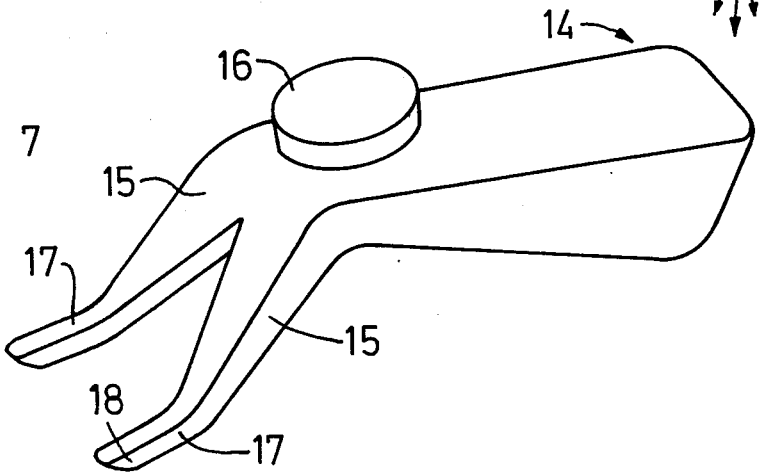
FIG. 7 shows in perspective, viewed obliquely from above, another embodiment of the invention in the form of a tripod.

The embodiment of the invention represented by FIG. 7 comprises a substantially "three-legged" bottle of flexible plastic. Leg 14 forms the actual hollow body to receive a liquid to be applied while the other two legs 15 are prongs arranged more or less in a V-form, the three legs coming together substantially at the location of a filling location 16. Filling location 16 comprises a screw cap means or some other such suitable closable means that will facilitate the addition of liquid to be applied and will then close tightly. At their tips the prongs 15 are approximately parallel to each other and form skid-type projections 17, each having at least one spray opening 18 which, as discussed above, lies on the side away from the other prong. Here, too, the liquid is squeezed out through the outlet or spray openings by pressure applied to the body, while the prongs are simultaneously being moved over the scalp. The use of two prongs provides that one obtains a sure feeling for the position of the bottle in which the outlet or spray openings have an optimum position, which is assured by simultaneous placement of both ends.

Instead of a screw closure for the body 1, a snap closure may be provided. Also, the bottle need not necessarily be designed as an upright bottle and may have a cross-section other than block-shaped, such as circular or oval.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A scalp applicator means for applying liquid to the scalp comprising a hollow body and an applicator means, wherein said applicator means comprises two forked prongs having at least at their ends a cross-section comprising a square with rounded edges, each of which prongs has at its end at least one outlet or spray opening; the outlets or spray openings on each prong are positioned laterally on the sides of the prongs away from each other and are arranged in an edge of each prong near the scalp on a diagonal basis in the rounded portion of the edge; the prongs are substantially parallel and are positioned symmetrically with regard to a longitudinal median plane of the body; and the prongs terminate in a flat surface in order to form skids, whereby the location of the openings precludes clogging of the openings by flakes of skin from the scalp.

2. A scalp applicator means for applying liquid to the scalp comprising a hollow body and an applicator means, wherein said applicator means comprises two forked prongs having at least at their ends a cross-section comprising a square with rounded edges, each of which prongs has at its end at least one outlet or spray opening; the outlets or spray openings on each prong are positioned laterally on the sides of the prongs away from each other and are arranged in an edge of each prong near the scalp on a diagonal basis in the rounded portion of the edge; and the prongs terminate in a flat surface in order to form skids, whereby the location of the openings precludes clogging of the openings by flakes of skin from the scalp.

3. The scalp applicator means of claim 2 which comprises a separate screw or snap closure for the body.

4. The scalp applicator means of claim 3 which is capable of standing on a flat surface as an upright structure with the body opening at the top.

5. The scalp applicator means of claim 2, wherein the prongs are inclined away from the longitudinal axis of the body and the base and tip of the prongs are on opposite sides of the body relative to the longitudinal axis.

* * * * *